US006450461B1

(12) United States Patent
Lohmann

(10) Patent No.: US 6,450,461 B1
(45) Date of Patent: Sep. 17, 2002

(54) TRASH BAG HOLDER

(76) Inventor: Kenneth S. Lohmann, 25 Aqua Dr., Southampton, NY (US) 11968

( * ) Notice: Subject to any disclaimer, the term of this patent is extended or adjusted under 35 U.S.C. 154(b) by 914 days.

(21) Appl. No.: 08/692,016

(22) Filed: Aug. 2, 1996

(51) Int. Cl.[7] ..... B65B 67/04
(52) U.S. Cl. ..... 248/99; 248/97
(58) Field of Search ..... 248/95, 99

(56) References Cited

U.S. PATENT DOCUMENTS

| | | | | |
|---|---|---|---|---|
| 544,585 | A | * | 8/1895 | Mayo ..... 248/99 X |
| 669,660 | A | * | 3/1901 | Pierce ..... 248/99 |
| 3,836,037 | A | * | 9/1974 | Bass ..... 248/99 X |
| 3,936,087 | A | | 2/1976 | Alexander |
| 4,037,778 | A | | 7/1977 | Boyle |
| 4,287,701 | A | | 9/1981 | Washington |
| 4,299,365 | A | | 11/1981 | Battle |
| 4,411,300 | A | | 10/1983 | Rico |
| 4,488,697 | A | | 12/1984 | Garvey |
| 4,530,533 | A | * | 7/1985 | Dieter ..... 248/99 X |
| 4,548,372 | A | | 10/1985 | Lutzker |
| 4,659,045 | A | * | 4/1987 | Flynn ..... 248/99 |
| 4,664,348 | A | | 5/1987 | Corsaut, III et al. |
| 4,697,834 | A | | 10/1987 | Scott |
| 4,749,011 | A | * | 6/1988 | Rylander ..... 248/99 X |
| 4,759,518 | A | | 7/1988 | Yardas |
| 4,760,982 | A | | 8/1988 | Cooke |
| 4,765,579 | A | | 8/1988 | Robbins, III et al. |
| 4,832,291 | A | | 5/1989 | Nelson et al. |
| 4,832,292 | A | | 5/1989 | Beckham |
| 4,867,401 | A | | 9/1989 | Graff |
| 4,940,201 | A | | 7/1990 | Kurth |
| D309,966 | S | | 8/1990 | Bishop |
| 5,000,406 | A | | 3/1991 | Petersen |
| 5,014,943 | A | | 5/1991 | Nelson et al. |
| 5,065,965 | A | | 11/1991 | Aulabaugh |
| 5,088,667 | A | | 2/1992 | Olsen |
| 5,106,041 | A | | 4/1992 | Jelincic |
| 5,107,666 | A | | 4/1992 | Rahtican |
| 5,129,609 | A | | 7/1992 | Tobin |
| 5,139,219 | A | | 8/1992 | Navarro |
| 5,163,645 | A | | 11/1992 | Caruso |
| 5,180,125 | A | | 1/1993 | Caveney |
| 5,213,291 | A | | 5/1993 | Wiebe |
| 5,271,589 | A | | 12/1993 | Belous |
| 5,323,990 | A | | 6/1994 | Graves |
| 5,427,340 | A | | 6/1995 | Stromsmoe et al. |
| D361,185 | S | | 8/1995 | Seiler et al. |
| 5,454,535 | A | | 10/1995 | Thomson et al. |
| 5,570,862 | A | | 11/1996 | Nugent |
| 5,588,622 | A | | 12/1996 | Gordon, Sr. |

* cited by examiner

*Primary Examiner*—Lanna Mai
*Assistant Examiner*—Hanh V. Tran
(74) *Attorney, Agent, or Firm*—Sofer & Haroun, LLP

(57) ABSTRACT

A device for holding open and facilitating the filling of a trash bag with leaves, grass, debris or the like is provided. The device is comprised of a frame including a top wall, a bottom wall and at least one set of opposite side walls, and further including entry and exit ends having a hollow interior area extending therebetween. The sidewalls are provided with holes therethrough proximate entry end, the holes having corresponding slits. The frame is configured to receive on its exit end a specially configured trash bag having two knots tied within the opening edge of the bag. The bag is placed upon the exterior of the exit end of the frame and pulled toward entry end so that the knots of the bag line up with the holes in the sidewalls. The knots are pulled through the holes and retained in the corresponding slits such that the bag is securely retained on the frame which maintains the bag in a fully open position on the ground or floor surface so as to facilitate sweeping or raking grass, leaves, garbage and other debris or the like into the bag. The frame is also provided with a handle to facilitate holding and transporting the frame.

14 Claims, 7 Drawing Sheets

TRASH BAG HOLDER

FIELD OF THE INVENTION

This invention relates to a trash bag holder, and in particular, to a trash bag holder for retaining a plastic trash bag for facilitating the sweeping of leaves, garbage, debris, or the like into the trash bag.

BACKGROUND OF THE INVENTION

Many homeowners dispose of leaves, grass, and other garbage by raking or sweeping the leave, grass, garbage and/or other debris into trash bags or lawn and leaf bags. Removing leaves and grass from a lawn or sweeping or removing garbage or debris from a home or office is often difficult to a person working alone who, in order to gather and discard the leaves or garbage, must simultaneously rake or sweep with one hand while using the other hand to hold open the trash bag into which the leaves or garbage is collected. As such, the job of collecting leaves or garbage is a tedious and time consuming one. This task becomes even more difficult and unbearable to those with bad backs or those who suffer from arthritis or bone ailments. Prior art devices have included a variety of different designs which attempt to alleviate this burdensome task by holding a trash bag open in a horizontal to alleviate the hardships associated with the collection of leaves and garbage.

In U.S. Pat. No. 4,530,533, a support collar for a trash bag is disclosed that is formed from a foldable cardboard material, which when assembled, has two side walls, each side wall having an opening therethrough and a slot disposed one the edge of and open end of the collar and remote from the opening. In use, the opening of the trash bag is pulled over the support collar with opposite edge portions of the bag pulled through the openings in the side wall and wedged into the slots for retention.

In U.S. Pat. No. 4,832,292, there is disclosed a method and apparatus for holding a trash bag. This apparatus is a one-piece injection molded plastic apparatus for facilitating the filling of a trash bag with leaves, grass, sweepings, etc. The apparatus has a large open perimeter and a protruding lip which is inserted into a trash bag and which holds the bag open to permit leaves, etc. to be swept in.

In U.S. Pat. No. 5,000,406, there is disclosed an apparatus for catching leaves, trash or other debris which includes a housing having a frontal opening and a rear opening wherein the rear opening is inserted into the mouth of a trash bag and which holds the bag open to facilitate sweeping or raking leaves or debris into the bag. Leaves or debris are received in the frontal opening and pass through the housing into the trash bag. The housing further comprises a bag retainer or strap which fits around the frontal opening so as to retain the bag thereon.

In U.S. Pat. No. 5,271,589, there is disclosed an apparatus comprised of a tubular base and a funnel for supporting a plastic trash bag in an open and upright position so that an individual fills the trash bag without having to repeatedly reopen it or obtain assistance from other persons.

Each of the aforementioned prior art devices, however, are saddled with the problem of retaining and adequately securing the bag to the device as leaves or garbage are being swept, raked or placed into the attached bag. For instance, in U.S. Pat. Nos. 4,530,533 and 4,832,932, the bag may come loose from the holder at any time while the leaves or garbage are being raked or swept into the bag. Additionally, as the bag becomes increasingly full, it may come loose or completely fall off the garbage bag holder hence spilling the leaves or garbage which has already been collected. In U.S. Pat. No. 5,000,406, as the bag becomes heavier during filling, the bag may slip from within the grasp of the retainer strip or the bag may tear under its own weight. In U.S. Pat. No. 5,271,589, the bag is held vertically as leaves or garbage are placed within the bag either by hand or with a shovel. This requires lifting of the grass, leaves or garbage which may be heavy. As well, the bag may simply loosen and slide down off the device as the bag fills near capacity.

None of the prior art devices discloses a garbage or trash bag holder in combination with a trash bag, such that the trash bag is configured to be attached to the garbage or trash bag holder to be securely retained thereon. Accordingly, there is a need for a durable trash bag holder in combination with a conventional plastic trash bag wherein the trash bag is configured to be firmly and securely retained on the trash bag holder and which avoids the disadvantages discussed above.

OBJECTS AND SUMMARY OF THE INVENTION

It is thus a general object of the present invention to provide an apparatus for maintaining a trash bag in an open manner to facilitate its filling with leaves, trash or other debris.

A more specific object of the present invention is to provide a conventional plastic trash bag configured to be firmly and securely retained on a trash bag holder configured to receive the trash bag and securely retain it thereon.

It is another object of the present invention to provide a trash bag holder for retaining a specially configured trash bag thereon and for maintaining the trash bag in an open manner to facilitate its filling with leaves, trash or other debris.

It is another object of the present invention to provide a trash bag holder in combination with a specifically configured trash bag which is securely retained on the trash bag holder and which is maintained in an open manner thereby eliminating the use of one's hands to hold the bag open while raking or sweeping leaves, trash or other debris into the bag.

It is a further object of the present invention to provide a trash bag holder in combination with a specifically configured plastic trash bag which when retained on the trash bag holder and maintained in an open manner permits large amounts of leaves, garbage and debris to be swept up in a shorter period of time.

In accordance with one aspect of the present invention, a frame made from any of numerous materials such as plastic, fiberglass, PVC and metal is provided having a front entry end defining an entry opening, and a rear exit end defining an exit opening. The frame which is advantageously square or rectangular shaped, but may be one of a number of other shapes, generally includes a top wall, a bottom wall and at least one set of opposite side walls therebetween. The frame which is completely hollow therethrough has an engaging flap which extends from the bottom side wall of the front opening to facilitate the sweeping or raking of leaves or debris onto the trash bag holder and hence into the trash bag. Each of the set of opposite side walls is provided with a bore therethrough, the bore being located proximate the front end of the trash bag holder, with each bore having a slit or notch extending from the bore towards the rear exit end. The top wall of the frame may optionally be provided with a handle to facilitate lifting of the device or for holding while sweeping or raking leaves or debris into the bag.

A conventional plastic trash bag is also provided in combination with the frame of the present invention. The trash bag is specifically configured to be received and securely retained by the frame of the trash bag holder of the present invention. To configure the trash bag for use with the frame of the trash bag holder, two knots are tied in the bag on opposite sides of the open mouth of the bag. In use, the open end of the trash bag is placed about the perimeter of the exit end of the frame and pulled toward the entry end such that the knots of the bag are directed along the side walls of the frame as the bag is pulled toward the entry end. When the mouth of the bag is just proximate the entry end opening of the frame, each knot on the bag is inserted through the bore toward the interior of the frame and then "locked" or secured there by directing the knots into the slits extending from the bores. This combination provides a device wherein a bag is specially configured to be used in combination with a trash bag holder apparatus for facilitating the sweeping or raking leaves, garbage or debris therein.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

Figure 6:
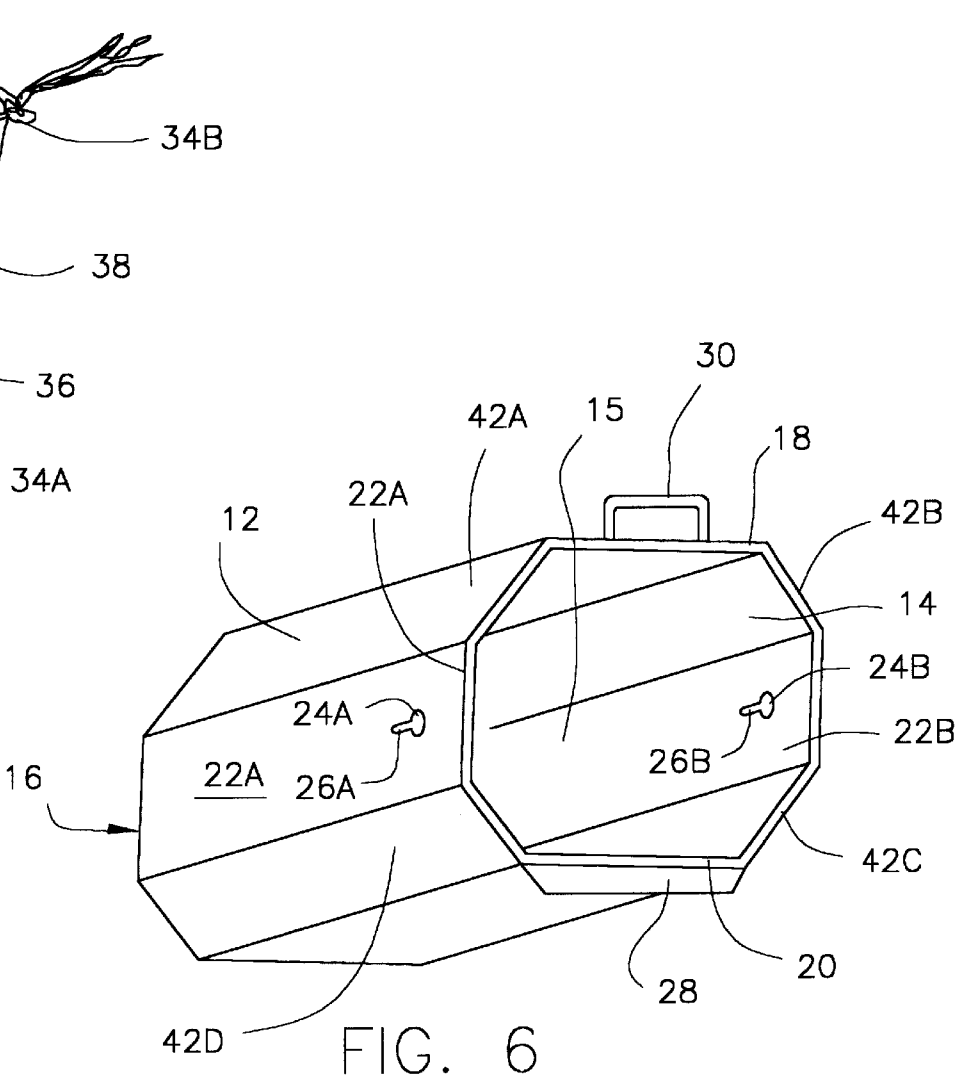
Figure 5:
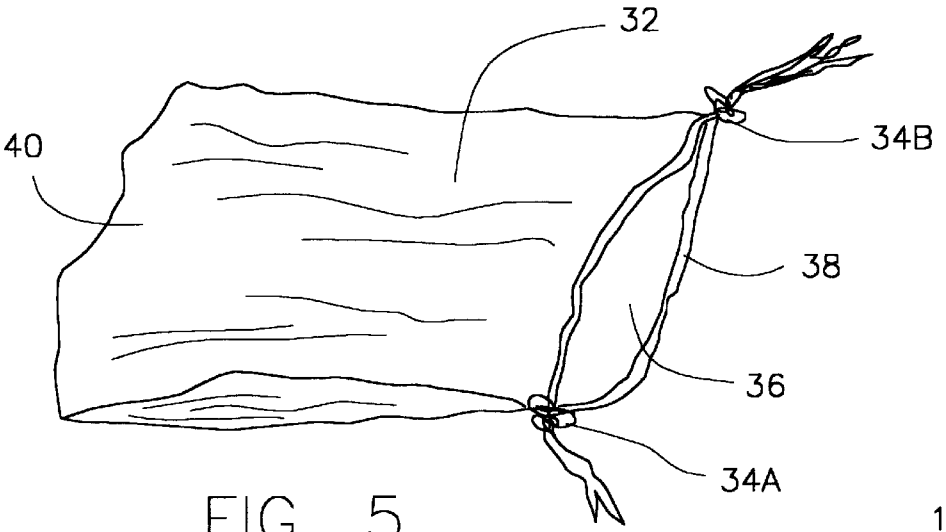
Figure 8:
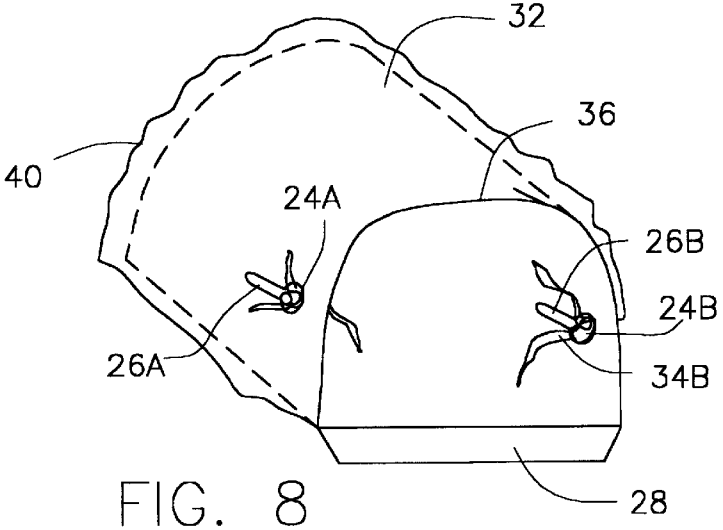
Figure 7:
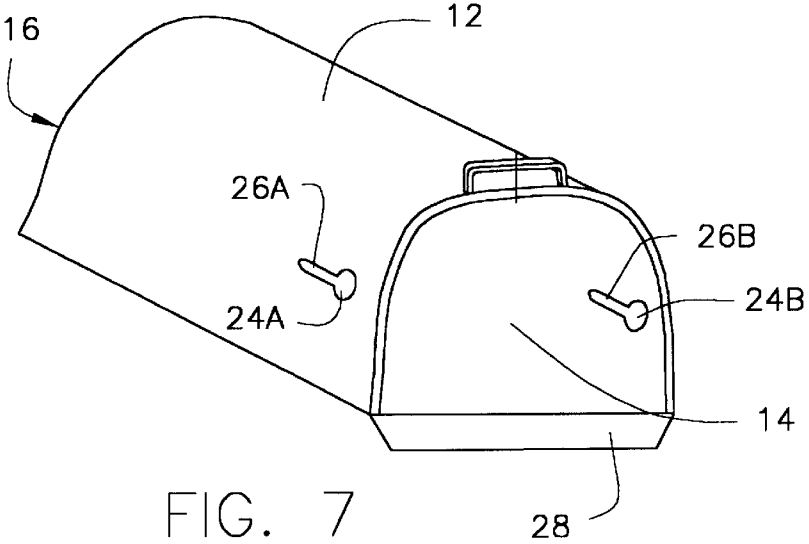
Figure 9:
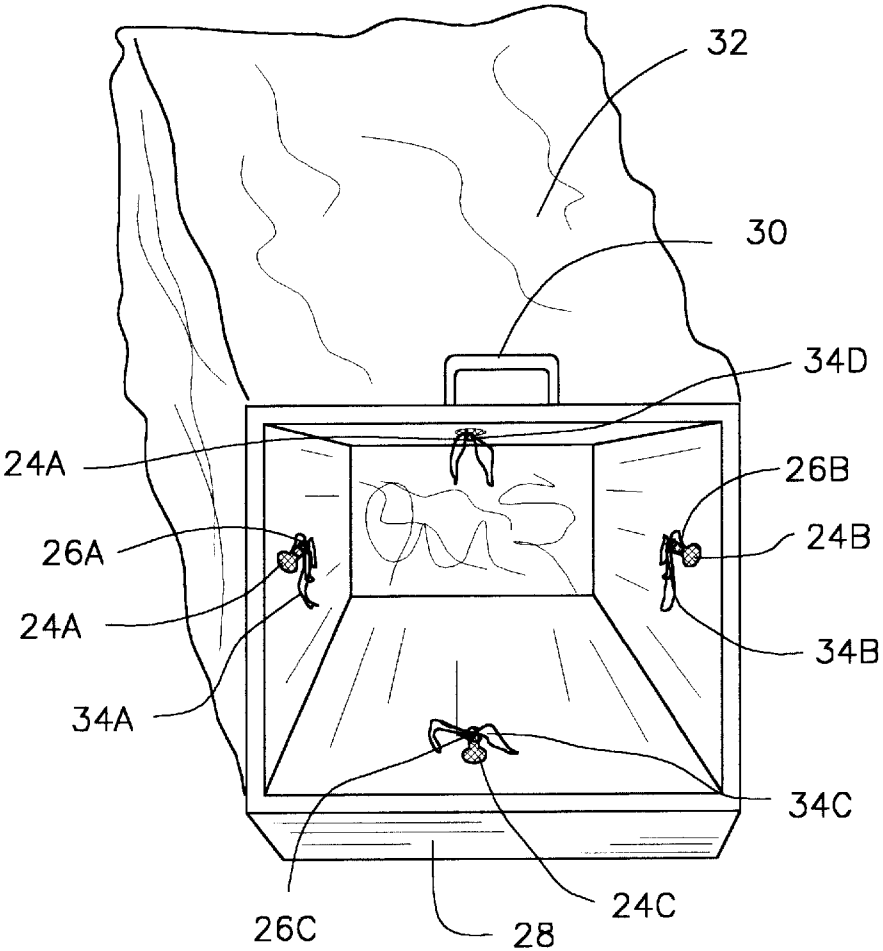
Figure 10:
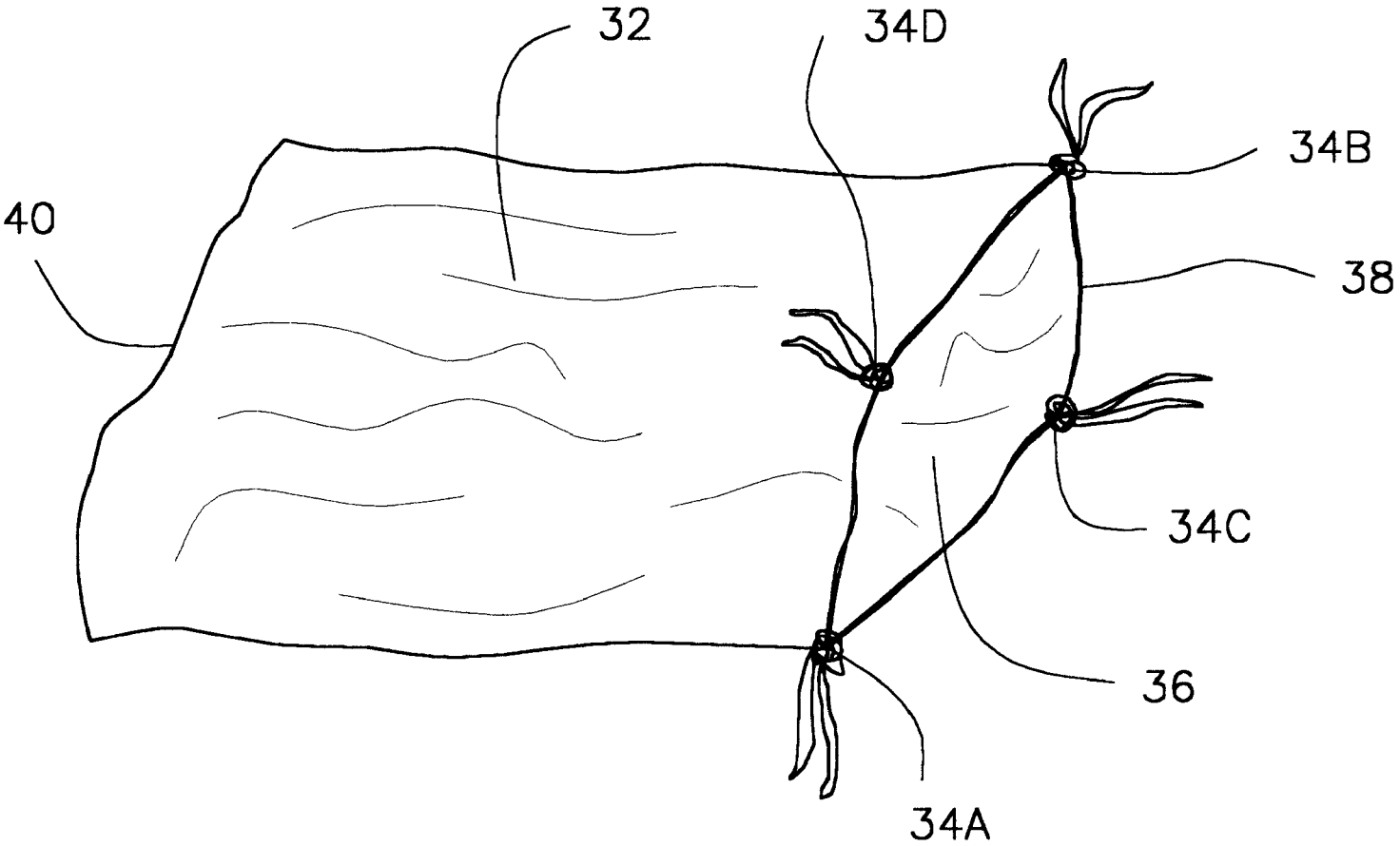

FIG. 5 a perspective view of the specially configured knotted trash bag of the present invention;

FIG. 6 a perspective view of an alternative embodiment of the trash bag holder of the present invention in an octagonal shape and shown without the knotted trash bag attached to it;

FIG. 7 illustrates a perspective view of an alternative embodiment of the trash bag holder of the present invention in a semi-circular shape and shown without the knotted trash bag attached to it;

FIG. 8 illustrates a perspective view of the semi-circular trash bag holder apparatus of the present invention as illustrated in FIG. 7, with the knots of the knotted trash bag secured and retained in the slits of the holes in the sidewalls of the trash bag holder apparatus;

FIG. 9 is a perspective view of another alternative embodiment of the trash bag holder of the present invention having four holes for retaining a knotted trash bag thereon;

FIG. 10 illustrates a perspective view of an alternative embodiment of the specially configured knotted trash bag having four knots for retention upon the embodiment illustrated in FIG. 9.

DETAILED DESCRIPTION OF THE PRESENTLY PREFERRED EMBODIMENT

Figure 1:
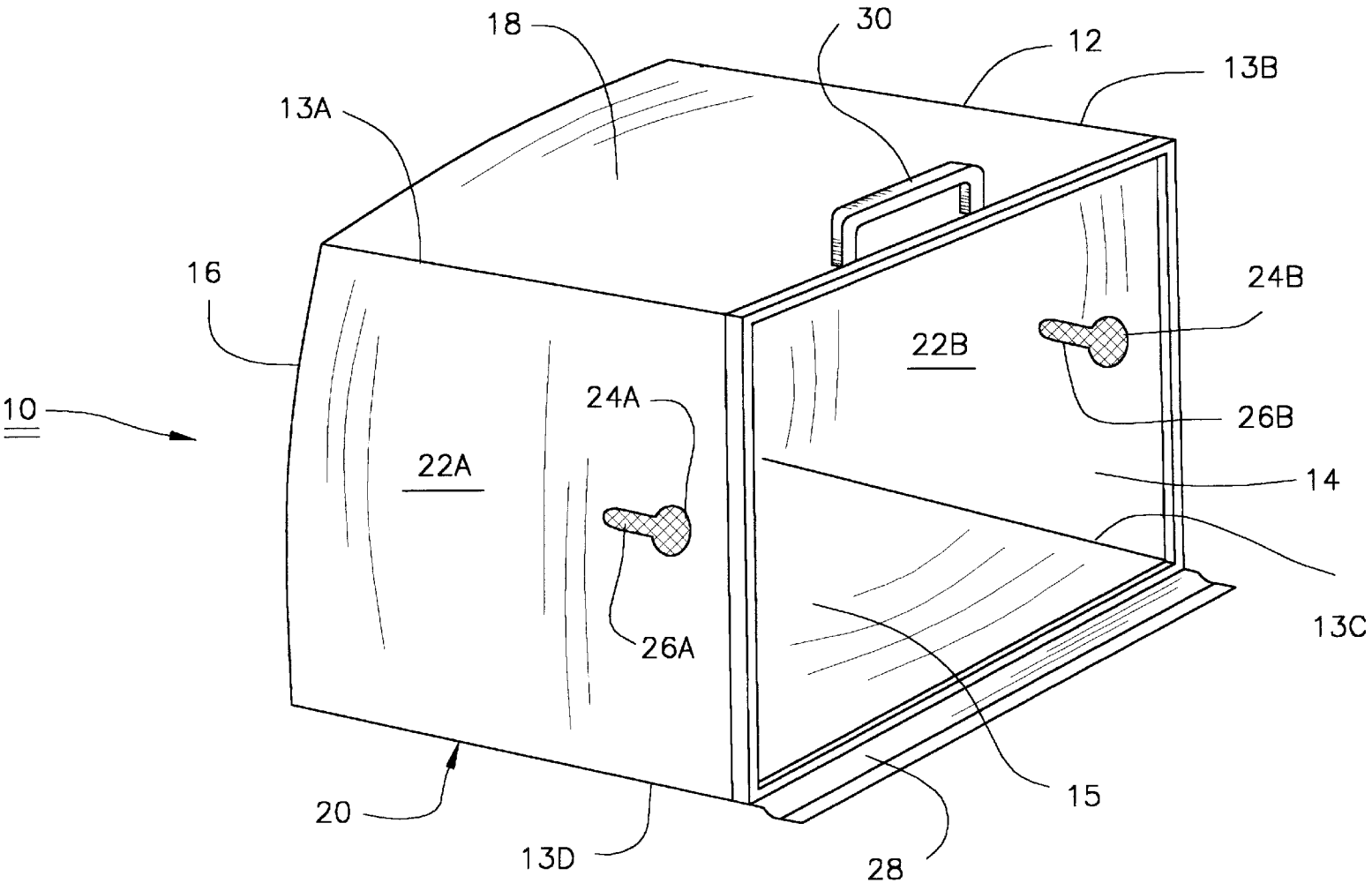
FIG. 1 illustrates a perspective view of the trash bag holder apparatus of the present invention shown without knotted trash bag attached to it.
Figure 3:
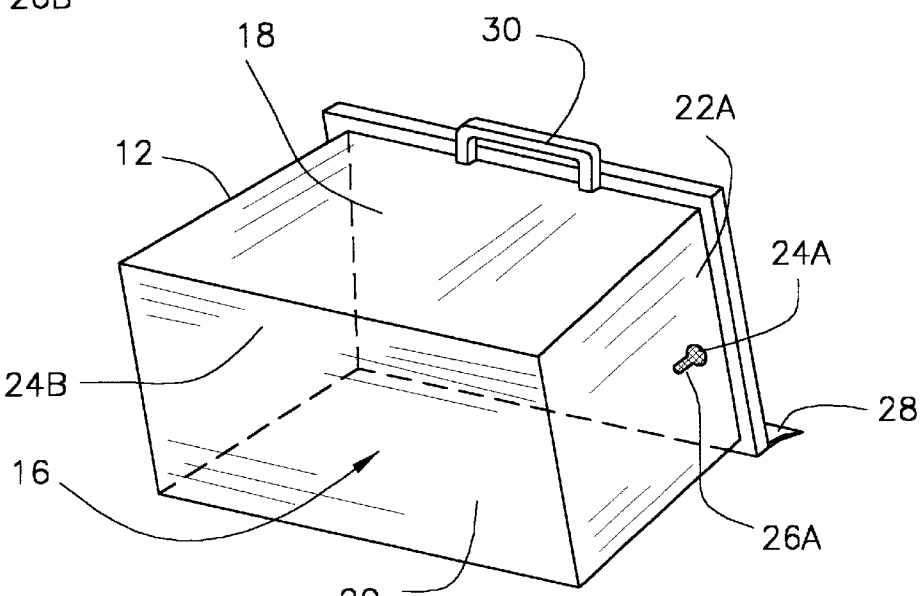
FIG. 3 illustrates an elevational view of the trash bag holder apparatus of the present invention viewed from the and without the knotted trash bag attached to it.
Figure 2:
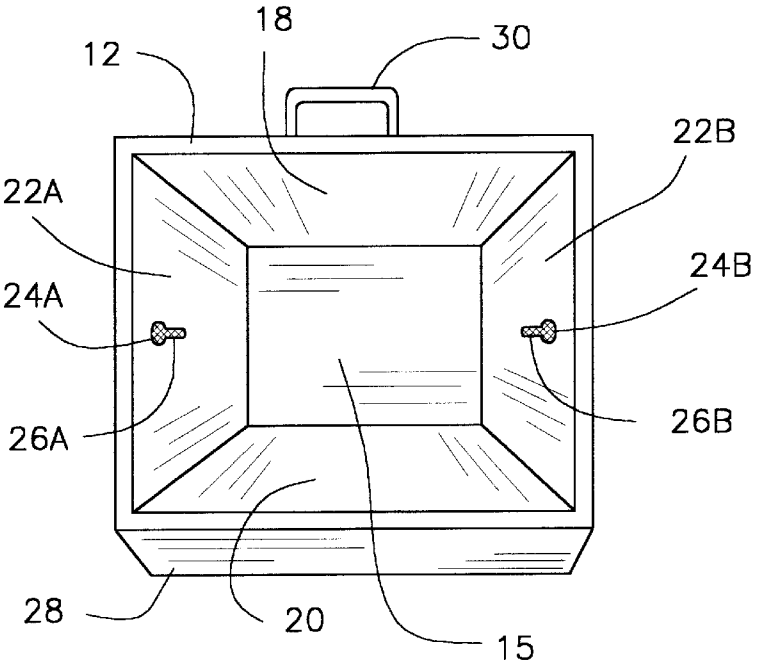
FIG. 2 illustrates a front elevation view of the trash bag holder apparatus of the present invention without knotted trash bag attached to it.

With initial reference to FIGS. 1–3, the trash bag holder 10 of the present invention is shown in its preferred embodiment. Trash bag holder 10 is comprised of a unitarily molded frame 12 having a top wall 18, a bottom wall 20, and opposite side walls 22*a* and 22*b*. Frame 12 which has a front entry opening 14 and a rear exit opening 16 defining a hollow chamber 15 extending within frame 12 between entry opening 14 and exit opening 16 is configured to accommodate a specially configured trash bag 32 (shown in FIGS. 4 and 5 and discussed herein with greater detail with reference to FIGS. 4 and 5) upon its exterior. The exterior of frame 12 is limited by the dimensions of the trash bag 32 attached to frame 12, however, frame 12 may be constructed in different sizes to accommodate different size bags 32. The connection points 13*a*–13*d* of the walls of frame 12 are smooth to prevent tearing or shredding of the bag placed upon it. The bottom wall 20 has a tapered edge or flap 28 extending outwardly from front entry end opening 14 for facilitating the sweeping or raking of leaves, grass, garbage or other debris into frame 12 and eventually into a bag attached to frame 12. Handle means 30 are attached to top wall 16 to facilitate the lifting, carrying and transporting of frame 12.

Side walls 22*a* and 22*b* include circular holes 24*a*, 24*b* arranged proximate front entry opening 14. Circular holes 24*a* and 24*b* are preferably one to two inches in diameter. Each hole 24*a* and 24*b* is further provided with a corresponding slit 26*a*, 26*b* extending horizontally from holes 24*a* and 24*b* toward rear exit end 16.

Figure 4:
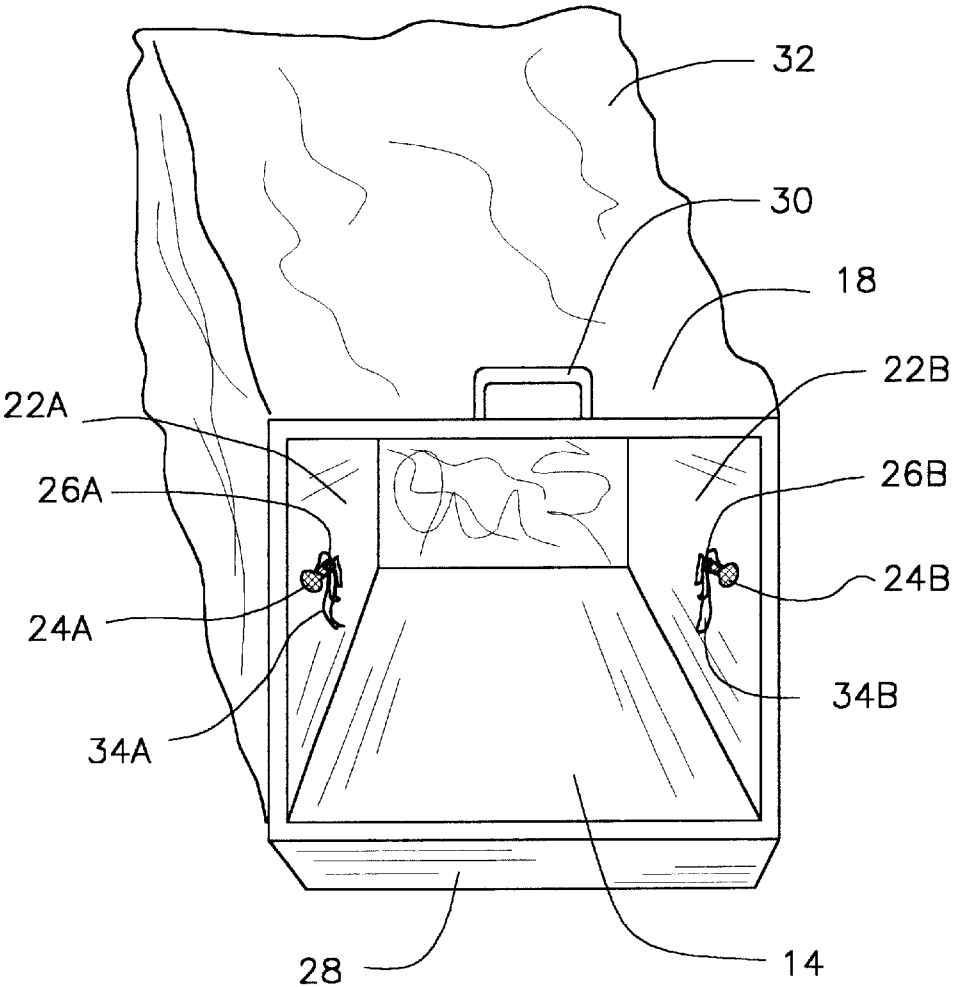
FIG. 4 illustrates a front perspective view of the trash bag holder apparatus of the present invention with the knots of the knotted trash bag secured and retained in the slits of the holes in the sidewalls of the trash bag holder apparatus.

FIG. 4 illustrates the specially configured bag 32 securely attached to frame 12 for retention thereon. Bag 32 shown in FIG. 5 unattached from frame 12 has an open end 36 defined by a circumferential edge 38 and a closed end 40. For use in containing leaves or large amounts of trash, bag 32 is preferably a plastic trash bag such as a GLAD® heavy duty bag or a HEFTY® lawn and leaf bag. To configure bag 32 for secure retention in frame 12, at least two knots 34*a* and 34*b* are manually tied in the circumferential edge portion 38 of the open end 36 of bag 32. Knots 34*a* and 34*b* are to be received in holes 24*a* and 24*b* on side walls 22*a* and 22*b* of frame 12 and thus should be tied diametrically opposite one another on lip portion 38. After knots 34*a* and 34*b* are tied, open end 36 of bag 32 is slid onto rear exit end 16 of frame 12 and pulled forward on frame 12 toward front entry end 14. When open end 36 of bag 32 nears the front entry end 14 of frame 12, knots 34*a* and 34*b* are inserted through holes 24*a* and 24*b*, respectively so that knots 34*a* and 34*b* are within hollow chamber 15 of frame 12. Knots 34*a* and 34*b* are then pulled into the corresponding slits 26*a* and 26*b* of holes 24*a* and 24*b* and directed toward rear exit end 16 of frame 12 to be securely retained therein. When bag 32 becomes full, knots 34*a* and 34*b* are slid toward holes 24*a* and 24*b* and pulled through, such that bag 32 is released from frame 12. Bag 32 may then be easily slid off of frame 12 and tied or closed in any known manner for disposal in a garbage pail or for placement at curbside.

It is to be appreciated that frame 12 is not limited to a square or rectangular configuration as illustrated in FIGS. 1–4. Frame 12 may optionally be configured in other shapes such as octagonal or circular. As shown in FIG. 6, frame 12 is octagonal in shape and comprises front entry end 14, rear exit end 16, top wall 18, bottom wall 20 having a flap 28, and opposite side walls 22*a* and 22*b*, with hollow chamber 15 defined therein. Due to its shape, octagonal frame 12 comprises four additional slanted sidewalls 42*a*–42*d*. Sidewalls 22*a* and 22*b* include holes 24*a* and 24*b* provided with corresponding slits 26*a* and 26*b* for retaining knots 34*a* and 34*b* of bag 32 (as shown in FIG. 5). Furthermore, in another embodiment, frame 12 may be configured as a semi-circle as shown in FIG. 7 wherein bag 32 is slid over frame 12 from rear exit end 16 toward front entry end 14. As illustrated in FIG. 8 knots 34*a* and 34*b* of bag 32 are inserted into holes 24*a* and 24*b* and securely retained in slits 26*a* and 26*b*.

In still a further embodiment of the device of the present invention, frame 12 may be configured as a square or rectangle having four holes 24*a*–24*d* with corresponding slits 26*a*–26*d*, as shown in FIG. 9, such that the two additional holes in top wall 18 and bottom wall 20 permit a bag 32 configured with four knots 34*a*–34*d* on circumferential edge 38 (as shown in FIG. 10) to be received therein so as to provide even greater retention of bag 32 on frame 12.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto. It is to be understood that the drawings are not necessarily drawn to scale, but that they are merely conceptual in nature.

It is to be understood that the drawings are not necessarily drawn to scale, but that they are merely conceptual in nature.

What is claimed is:

1. A device for containing leaves, grass, or debris, said device comprising:

a hollow frame having a front entry end with a bottom side and a top side and a rear exit end, said frame defined by a top wall, a bottom wall and opposite sidewalls, each said sidewall having at least one hole therethrough, each of said holes having a corresponding longitudinal slit extending from said hole;

a trash bag having an open mouth end and a closed end for receiving said debris along a horizontal axis transverse to the plane containing said front entry and to the plane containing said rear exit of said frame, said open mouth end having a peripheral edge wherein at least two knots are tied in said peripheral edge of said open mouth end of said bag for engagement with said frame via said holes, said holes having a size configured to correspond with said knots, said open end of said trash bag received upon said rear exit end, wherein said open mouth of said trash bag covers said hollow frame and said closed end of said trash bag extends beyond said hollow frame, said knots being drawn through said holes within said opposite sidewalls of said frame and securely but detachably retained in said corresponding slits of said holes.

2. The device of claim 1, wherein said holes are juxtaposed substantially opposite each other on said frame.

3. The device of claim 1, further comprising a front engaging flap, said flap protruding from said bottom side of said front end and extending along the surface to be swept for facilitating the filling of said trash bag with leaves, debris, and the like.

4. The device of claim 1, further comprising handle means attached to said frame for holding and transporting said frame.

5. The device of claim 1, wherein said frame is comprised of injection molded plastic.

6. The device of claim 1, wherein said frame is comprised of PVC.

7. The device of claim 1, wherein said frame is comprised of metal.

8. The device of claim 1, wherein said frame is rectangular in shape.

9. The device of claim 1, wherein said frame is square in shape.

10. A device for containing leaves, grass, or debris, said device comprising:

a frame having a front entry end with a bottom side and a top side and a rear exit end, said frame further comprising a top wall, a bottom wall, and at least one set of opposite side walls, said frame having a hollow interior area extending from said front entry end to said rear exit end, said side walls having a plurality of holes therethrough proximate said entry end of said frame, each of said holes having a corresponding longitudinal slit extending therefrom;

a trash bag having an open mouth end and a closed end for receiving said debris along a horizontal axis extending transversely to planes formed by said front entry and said rear exit of said frame when said bottom wall is disposed on the ground, said open mouth end having a peripheral edge wherein a plurality of knots are tied in said peripheral edge of said open mouth end of said bag, said knots corresponding in size and position with said holes in said frame, said open end of said trash bag received upon said rear exit end of said frame and fitted over a majority of said frame, said knots being drawn through said holes to a position within said top wall, said bottom wall and said opposite sidewalls of said frame and securely but detachably retained in said corresponding slits of said holes.

11. The device of claim 10, further comprising a front engaging flap, said flap protruding from said bottom side of said front end and extending along the surface to be swept for facilitating the filling of said trash bag with leaves, debris, and the like.

12. The device of claim 10, further comprising handle means attached to said frame for holding and transporting said frame.

13. A device having a trash bag and a hollow frame having a front entry end and a rear exit end and defined by a top wall and a bottom wall and opposite sidewalls having holes therethrough, said trash bag comprising an open mouth end and a closed end for receiving debris along a horizontal axis extending transversely to the plane containing said front entry and to the plane containing said rear exit of said frame, when said bottom wall is disposed on the ground, said open mouth end having a peripheral edge having at least one knot tied in said peripheral edge of said open mouth end and engaged with said frame via said holes, said bag received upon said rear exit end of said frame and fitted over a majority of said frame, wherein said open mouth end of said trash bag covers said hollow frame and said closed end of said trash bag extends beyond said hollow frame, said holes each having a size corresponding with said knot, and wherein said knot is drawn through said hole within walls of said frame and securely but detachably retained therein.

14. A method for retaining a specially configured trash bag on a device for facilitating the filling of a trash bag with leaves, grass, or debris, the device comprising a unitarily molded frame having a front entry end and a rear exit end at least one set of opposite sidewalls extending between said front and rear ends to define a hollow interior area extending therein, said side walls each having a hole therethrough, said hole having a corresponding slit for retaining a trash bag on said frame, and which comprises the steps of:

knotting at least two areas of a peripheral edge of a trash bag opening such that said knots correspond in size and position with said holes of said frame;

placing said trash bag on said exit end of said frame and pulling said trash bag toward said entry end of said frame;

placing said knots through said holes in said sidewalls and retaining said bag in said device by securing said knots within said slits which extend from said holes.

* * * * *